United States Patent [19]

Skobel

[11] Patent Number: 4,534,090

[45] **Date of Patent: * Aug. 13, 1985**

[54] RELEASABLE CLASP

[76] Inventor: Max Skobel, 10 Lynwood Rd., Edison, N.J. 08817

[ * ] Notice: The portion of the term of this patent subsequent to Oct. 11, 2000 has been disclaimed.

[21] Appl. No.: 500,374

[22] Filed: Jun. 2, 1983

Related U.S. Application Data

[63] Continuation-in-part of Ser. No. 303,790, Sep. 21, 1981, Pat. No. 4,408,375.

[51] Int. Cl.[3] ..... A47G 29/10

[52] U.S. Cl. ..... 24/625; 24/615

[58] Field of Search ..... 70/459; 411/508–510; 24/3 K, 293, 297, 453, 588, 614–627

[56] References Cited

U.S. PATENT DOCUMENTS

| | | | |
|---|---|---|---|
| 2,058,320 | 10/1936 | Jones | 24/625 |
| 2,330,770 | 9/1943 | Wiley | 24/618 X |
| 3,167,835 | 2/1965 | Bengtsson | 24/625 |
| 3,181,189 | 5/1965 | Leyden | 24/625 X |
| 3,345,706 | 10/1967 | Stokes | 24/625 X |
| 3,600,917 | 8/1971 | Krock | 70/459 |
| 3,979,934 | 9/1976 | Isenmann | 70/459 |
| 3,984,900 | 10/1976 | Cirelli | 24/238 |
| 4,024,607 | 5/1977 | Rosenberg et al. | 24/616 |
| 4,408,375 | 10/1983 | Skobel | 70/459 X |

FOREIGN PATENT DOCUMENTS

| | | | |
|---|---|---|---|
| 88086 | 8/1896 | Fed. Rep. of Germany | 24/615 |
| 130772 | 5/1902 | Fed. Rep. of Germany | 24/625 |
| 466126 | 5/1914 | France | 24/615 |

*Primary Examiner*—William E. Lyddane
*Assistant Examiner*—James R. Brittain
*Attorney, Agent, or Firm*—Goodman & Teitelbaum

[57] ABSTRACT

A releasable clasp having a female receiving member and a male insert member, the female receiving member including an elongated internal passageway which extends from one end thereof and has opposed retaining slots therein. The male insert member includes a body portion supporting a pair of forwardly directed, elongated, spaced apart, springy arms which are insertable into the passageway upon compression of the arms together. An enlarged hand portion extends outwardly from the leading end of each arm for releasably locking into a respective one of the retaining slots when the arms spread apart within the passageway. Each of the hand portions terminates at their free ends with an inwardly extending finger directed towards each other. One of the fingers is forward of and overlaps the other finger to define a unitary leading insertion portion, which can include a nose tip, for facilitating insertion of both arms into the passageway.

14 Claims, 8 Drawing Figures

RELEASABLE CLASP

RELATIONSHIP TO OTHER APPLICATIONS

This is a continuation-in-part application of prior application Ser. No. 303,790, filed on Sept. 21, 1981, now U.S. Pat. No. 4,408,375, for a "Releasable Connector".

BACKGROUND OF THE INVENTION

This invention relates to a connector, and more particularly to a releasable clasp which can be easily assembled and readily released.

In jewelry items, the use of a clasp is often necessary to hold together the opposite ends of an elongated piece of jewelry. For example, a necklace, bracelet or key chain frequently requires the joining together of opposing ends by means of a connector. Because the piece of jewelry is frequently put on and removed, a releasable type of connector is required. The connector must also be one that can be easily manipulated, and at the same time, it must provide a secured retention during its use.

One type of releasable connector is described in the aforementioned parent application. In that device, there is provided a receiving member having an internal passageway extending from one end thereof. A pair of diametrically opposed retaining slots are spaced along the passageway. An elongated insert member is provided, which has a pair of bifurcated springy legs insertable into the passageway when the legs are compressed together. At the end of each leg there is provided an outwardly extending foot which can releasably lock into each of the retaining slots. After the legs are inserted, and as the feet reach the retaining slots, the legs spread apart so that the feet are secured within the retaining slots.

Other types of clasps and key holder connectors have also been provided in the prior art. For example, in U.S. Pat. No. 3,600,917 there is provided a key ring connector with a slab-shaped female member which receives therein a male member formed of an elongated web with stepped outwardly extending detents that fit into notches in the female member. Another clasp is described in U.S. Pat. No. 3,967,351 which utilizes at least one hook on a male member that engages in a slot in a female receiving member. U.S. Pat. No. 4,150,464 describes a buckle which includes a releasable connector, and U.S. Pat. No. 3,979,934 describes a separable key holder having bifurcated legs fitting into a female receiving member. U.S. Pat. No. 2,099,655 describes a releasable connector for a mouting bracket having bifurcated legs fitting within a receiving member.

Other types of prior art brackets, clasps, or connectors have a male member with a blunt front end and bifurcated legs facing the rear thereof, with the male member being received in slots provided in a female member. For example, U.S. Pat. No. 1,440,068 has a pair of rearwardly directed bifurcated legs on a male member provided with a blunt front end, which is inserted into the female member. Similarly, U.S. Pat. Nos. 3,421,341 and 3,412,576 describe a chain bracket clasp which again has a pair of rearwardly directed bifurcated legs, one leg of which is inwardly bent to define a hook.

All of the aforementioned prior art clasp arrangements utilize the basic concept of a pair of separated legs which can be compressed together for insertion into a female member, and which can spread apart upon reaching a desired retaining position. Those clasps that utilize a blunt front end with the bifurcated legs being rearwardly directed, find difficulty when inserting the male member into the female member, and also must make additional provisions for attaching one end of the jewelry to the bifurcated legs, which extend rearwardly from the female member when retained therein. Accordingly, a more appropriate type of clasp would be one that utilizes the bifurcated legs in a forward directed orientation so that the legs are inserted into the female member by pressing them together, while a solid body portion of the male member extends rearwardly of the female member when retained therein, whereby the end of the jewelry can be connected to the solid body portion. However, in this last described arrangement utilizing the bifurcated legs as the leading portion of the male member, a problem results in that the bifurcated legs may straddle a wall of the female member when being inserted therein. More specifically, when trying to assemble the male and female members, rather than inserting both legs of the male member into the passageway of the female member, only one leg may be inserted therein with the other leg straddling the outside wall of the female member, and thus remaining outside of the female member. Accordingly, it may be awkward to assemble the parts of a clasp when the bifurcated legs are forwardly directed.

The aforementioned problem is further aggrevated when trying to close the clasp on a necklace, where the person's hands must manipulate the clasp from behind the person's neck. Further, when trying to close a bracelet with one hand, the insertion process also becomes aggravated.

SUMMARY OF THE INVENTION

Accordingly, it is an object of the present invention to provide a releasable clasp which avoids the aforementioned problems of the prior art devices.

Another object of the present invention is to provide a releasable clasp which can be used for interconnecting two items.

Still another object of the present invention is to provide a releasable clasp which can be easily interconnected and easily separated.

Still another of the present invention is to provide a releasable clasp having a pair of forwardly directed bifurcated legs insertable into a passageway of a female member, and wherein the legs are arranged to insure proper insertion of both legs into the passageway.

Still another object of the present invention is to provide a releasable clasp which is reduced in cost, easy to manufacture, simple to operate, and is readily usable.

Briefly, in accordance with the present invention, there is provided a releasable clasp including a female receiving member and an elongated male insert member. The female member includes an elongated internal passageway extending from a mouth at one end thereof. A pair of diametrically opposing retaining slots is spacedly positioned along the passageway. The male member includes a body portion supporting a pair of forwardly directed, elongated, spaced apart, springy arms which can be inserted into the passageway upon compression of the arms together. An enlarged hand portion is provided at the leading end of each arm for releasably locking into a respective one of the retaining slots as the arms spread apart, so that each of the hand portions extends through its associated slot. In this manner, the male insert member is securely retained within the female receiving member in a locked position. Each of the hand portions terminate at their free ends with an inwardly extending finger. One of the fingers is spaced in front of and in overlapping relationship with the other finger, to thereby define a unitary leading insertion portion for entry into the passageway. In this way, insertion of both arms into the passageway is facilitated, and the possibility of one arm straddling the outside wall of the passageway is avoided.

In an embodiment of the invention, the forward end of the leading insertion portion is formed into a nose tip in order to further facilitate entry of the arms into the passageway.

BRIEF DESCRIPTION OF THE DRAWINGS

With the above and additional objects and advantages in view, as will hereinafter appear, this invention comprises the devices, combinations and arrangements of parts hereinafter described by way of example, and illustrated in the accompanying drawings of an preferred embodiment in which.

In the various figures of the drawings, like reference characters designate like parts.

DETAILED DESCRIPTION OF THE PREFERRED EMBODIMENTS

Figure 1:
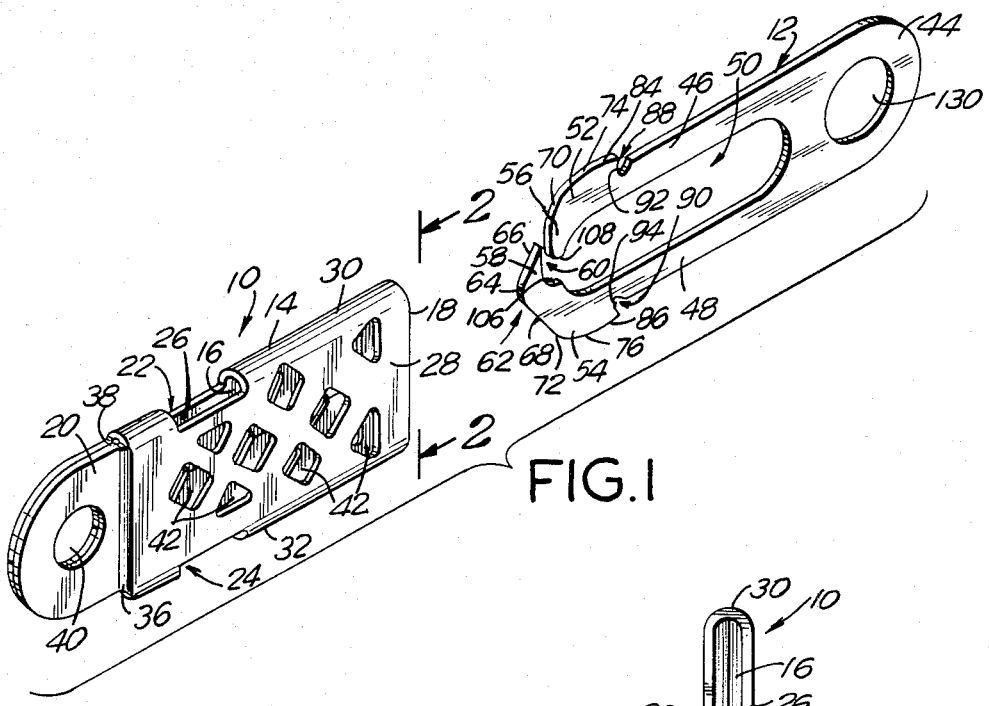
FIG. 1 is a perspective view of the releasable clasp, in accordance with the present invention, showing the male and female members in a separated condition.
Figure 2:
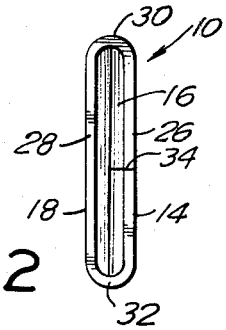
FIG. 2 is an end elevational view of the female member taken along line 2—2 of FIG. 1.

Referring now to the drawings, FIG. 1 shows the releasable claps including a female receiving member 10 and a male insert member 12. The female receiving member 10 includes a hollow body portion 14 to provide an elongated internal passageway 16 extending from a forward edge 18 of the body portion 14. The forward edge 18 is open to provide a mouth for the passageway. The rear end of the passageway 16 is closed and terminates with a tail portion 20. An opposing spaced apart pair of cutouts 22, 24 is provided in the peripheral edge walls of the body portion 14 to define retaining slots therethrough. The slots 22, 24 are substantially rearward of the passageway mouth, being preferably disposed adjacent to the tail portion 20, whereby the slots 22, 24 communicate with the passageway 16.

The female receiving member 10 is fabricated from a single sheet of material, preferably metal, which is folded over to define a pair of opposing spaced apart sidewalls 26, 28 which are interconnected to the upper and lower edges thereof by arcuate narrow upper and lower edges 30, 32. The sheet of material forming the female receiving member is interconnected at approximately the mid-section of the sidewall 26 along a joining line 34. The edges of the joining line 34 can be joined together by means of solder or any other suitable type of securing means. Alternately, if the material is of sufficient strength, the female receiving member can be retained in its shape without any type of securing means. It is further noted that the female receiving member could be formed from a rigid plastic material.

The two portions of the tail section 20 are pressed together to define a transversely extending ridge portion 36, 38 on opposite sides of the female receiving member 10 at the junction between the body portion 14 and the tail section 20. A centrally located aperture 40 is formed perpendicularly through the two portions of the tail section 20, so that the aperture 40 is spaced from the edges of the tail section 20, in addition to being spaced from the ridge portions 36, 38.

Although the female receiving member is shown to have a substantially flattened elongated shape, other suitable shapes could similarly be provided. Since the female receiving member 10 may be formed from a precious metal, especially when used as a jewelry clasp, there are provided openings 42 formed perpendicularly through the material of the body portion 14, in order to reduce the amount of material needed to form the female receiving member. At the same time, the openings 42 can be arranged to form a particular design, thus providing aesthetic beauty to the female receiving member.

The male insert member 12 includes a body portion 44 supporting a pair of forwardly directed, spaced apart, spring arms 46, 48 separated by an elongated slot 50. At the forward end of each arm, there is provided an enlarged hand portion 52, 54, which extend outwardly from the arm portions 46, 48. The hand portions each terminate at their forward free end in a finger portion 56, 58. Finger portion 58 extends in front of and overlaps finger portion 56. The channel 60 spaces the finger portions 56, 58 from each other.

The male insert member 12 is formed substantially flat so as to be able to fit between the sidewalls 26, 28 defining the passageway 16 in the female receiving member 10. In order to assemble the device, the male insert member is inserted into the female receiving member and pushed through the passageway 16 until the hand portions 52, 54 engage and lock into the cutout openings 22, 24. In order to position the male insert member into the female receiving member, the two arms, 46, 48 are compressed together. The arms then slide within the passageway 16 until the enlarged hand portions 52, 54 reach the cutout openings 22, 24, whereupon the two arms will then spread apart.

It should therefore be appreciated that the male insert member is formed of springy material, such as steel, gold, plastic, or any such other material. The longitudinal length of the slot 50 will depend upon the resiliency of the springy material, in order to provide sufficient compression of the two arms together so that the arms fit within the passageway.

Figure 3:
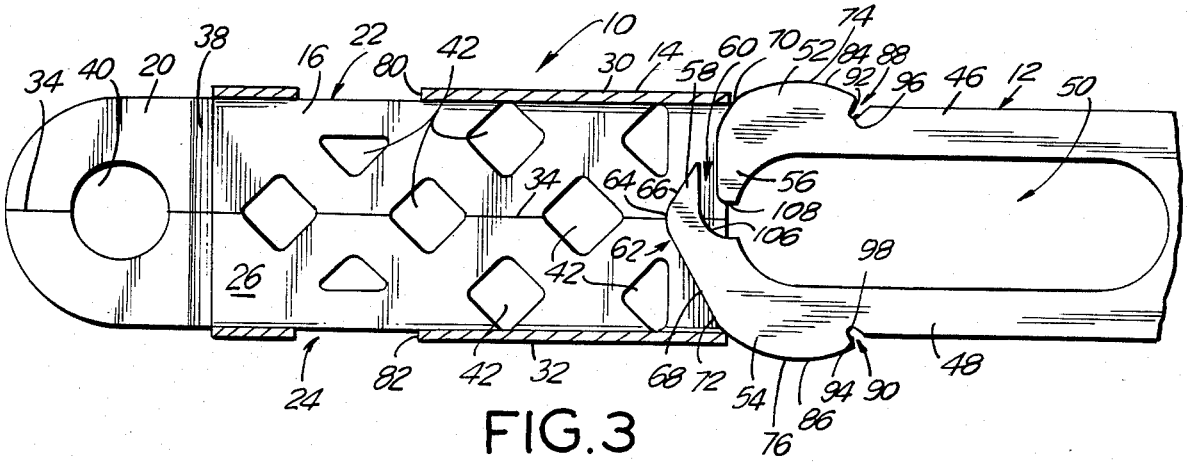
FIG. 3 is a cross sectional view showing initial penetration of the elongated male insert member into the female receiving member.

In order to facilitate insertion and removal of the male insert member, numerous shapes and cam surfaces are formed on the arms, hand portions and finger portions of the male insert member. Specifically, as shown in FIGS. 1 and 3, the finger portion 58, which is forward of and overlaps the finger portion 56, defines a leading insertion portion 62 which includes a nose tip 64 at substantially the central longitudinal axis of the male member. The central nose tip 64 facilitates initial penetration of the male insert member into the passageway of the female member.

On either side of the nose tip 64, there is provided forward a cam surface 66, 68. These cam surfaces are outwardly flared and rearwardly directed from the nose tip 64, so as to engage the edge 18 of the female receiving member 10, which defines the mouth of the passageway 16. The inclined angle of cam surface 66 continues onto the hand portion 52 to provide the cam surface 70. Similarly, the inclined angle of the cam 68 continues into the hand portion 54 to provide the cam surface 72 connected thereto. It should be appreciated, that although the inclined angle of cam surface 66 crosses the spaced channel 60, it does provide for a substantial cam surface extending from the finger portion 58 onto the hand portion 52. Accordingly, if the male member is not properly inserted in alignment with the passageway 16, the edge 18 forming the mouth can slide from the cam surface 66 onto the cam surface 70 to provide continuous guiding of the male member into the passageway 16. The cam surface 68 functions as a guide in the same above manner.

As a force is applied to push the male insert member into the female receiving member, the cam surfaces 66, 70 on one side and cam surfaces 68, 72 on the other side, can engage the mouth of the passageway 16 and thus serve to direct the two arms 46, 48 into the passageway 16 and toward each other so as to facilitate entry of the arms through the passageway 16.

Figure 4:
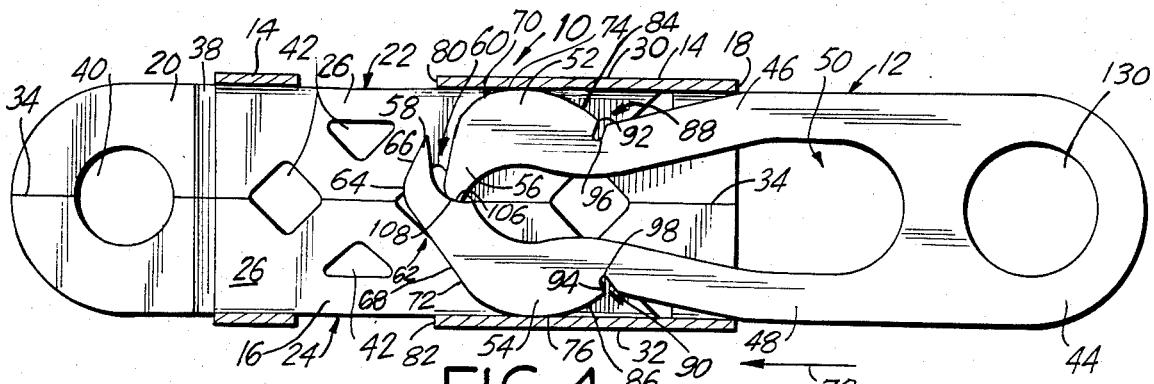
FIG. 4 is a cross sectional view similar to that shown in FIG. 3, showing progression of the male member within the female member.

Once the arms have been brought together sufficiently to permit their entry through the passageway 16, as shown in FIG. 4, a further cam surface 74, 76 formed rearwardly of the forward cam surfaces will facilitate passage of the male insert member 12 through the passageway 16. The cam surfaces 74, 76 are arcuate in shape and ride along the interior surfaces of the edge walls 30, 32 of the passageway. In this manner, the male insert member 12 can be easily moved through the female receiving member in the direction shown by the arrow 78 in FIGS. 4 and 5.

Figure 5:
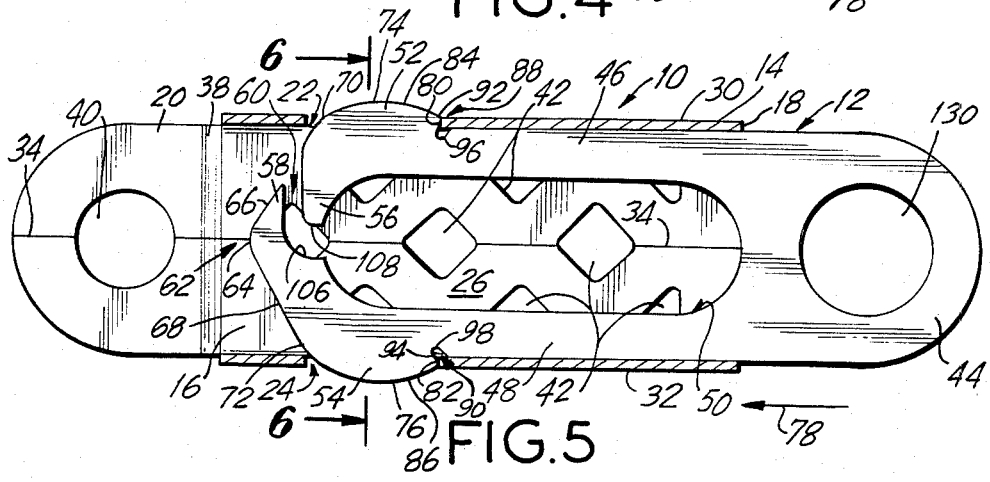
FIG. 5 is a cross sectional view similar to that shown in FIGS. 3 and 4, showing the male member locked within the female member.
Figure 6:
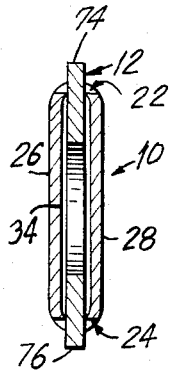
FIG. 6 is a cross sectional view taken along line 6—6 of FIG. 5.

The male insert member 12 continues through the passageway, as shown in FIG. 4, until the apexes of the cam surfaces 74, 76 engage the edges 80, 82 of the cutout openings 22, 24. After that point, the cam surfaces 84, 86, which are rearward of the cam surfaces 74, 76, facilitate the spreading apart of the bifurcated arms 46, 48, and at the same time, facilitate the entry of the enlarged hand portions 52, 54 into their locking position within the cutout openings 22, 24, as shown in FIG. 5. The rearward cam surfaces 84, 86 are inwardly curved and rearwardly directed from the arcuate cam surfaces 74, 76.

Rearward of the cam surfaces 84, 86, and at the junction between the arms 46, 48 and their respective enlarged hand portions 52, 54, there are provided notched junctions 88, 90. Each notched junction includes an inwardly directed edge 92, 94 rearward of the curved cam surfaces 84, 86. Each notched junction edge 92, 94 is forwardly directed and is at an inclined angular relationship with the longitudinal axis of the male insert member. In this manner, it provides a hook-like portion on its associated enlarged hand portions 52, 54, for locking onto the edges 80, 82 of the respective slots 22, 24.

Each notched junction 88, 90 includes an undercut portion 96, 98 extending inwardly from the notched junction edge 92, 94 to insure that the notched junction edge 92, 94 engages against the edge 80, 82 of the retaining slot 22, 24 in the locked position, respectively. As the forward movement of the male insert member 12 continues and as the enlarged hand portions 52, 54 lock within the slots 22, 24, the angled notched junctions 88, 90 will grab onto the edges 80, 82 of the slots 22, 24 and will serve to retain the hand portions 52, 54 locked in place and prevent its extraction when pulling in a direction opposed to the arrow 78 in FIG. 5.

With the male insert member 12 securely retained in the female receiving member, the enlarged hand portions 52, 54 will extend laterally outward through the cutout openings 22, 24. In order to release the male insert member from the female receiving member and thereby open the connector, pressure is provided onto the two enlarged hand portions 52, 54 in the direction shown by the arrows 100, 102 in FIG. 7. By pushing together the two enlarged hand portions 52, 54, the edges 80, 82 are released from the angled junction edges 92, 94 of the notched junctions 88, 90. The edges 80, 82 can again ride along the cam surfaces 84, 86 as the male member is being initially extracted by pulling it in a direction shown by the arrow 104 of FIG. 7. During the further extraction, the cam surfaces 74, 76 will again ride along the side walls 30, 32 of the passageway as the male insert member 12 is being fully extracted. Once the male insert member is fully pulled out of the female receiving member, the two arms 46, 48 will again separate and return to their original position, as shown in FIG. 1.

With prior art arrangements, as the two arms are about to be inserted into the passageway, only one of the arms might enter into the passageway while the other arm might extend on the outside wall of the edges 30 or 32. As a result, the male member will not be properly inserted. Although in most situations, the lack of a proper closure may be detected, in certain situations, especially when closing the clasp from behind the person's neck, so that the clasp is not in view, the failure of a proper closure may not even be detected. In those cases, the clasp may open and the article of jewelry may be lost.

By use of the overlapping finger arrangement of the present invention, this above mentioned problem is avoided. Specifically, it is noted that there is no horizontal slot or opening at the forward end of the male member, as in the aforementioned parent application. The normal mouth of the slot 50 is closed off at its forward end by means of the overlapping finger arrangement 56, 58. Accordingly, as the male member is brough towards the female member, both arms will automatically be guided into the passageway by means of the cam shaped arrangements and the nose configuration, to thereby insure that both arms will slide into the passageway without having one arm straddling outside of the walls 30, 32.

Figure 7:
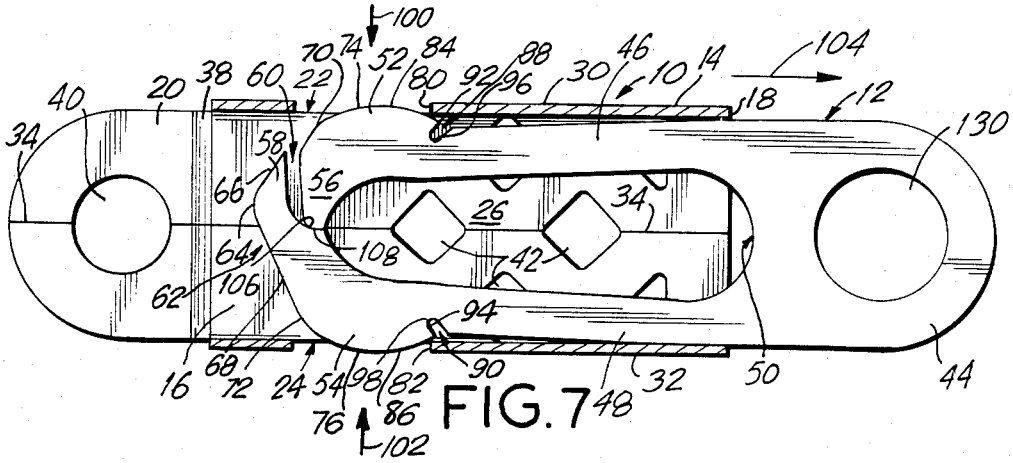
FIG. 7 is a cross sectional view similar to that shown in FIGS. 3–5, showing release of the male member from the female member for separation of the two members from each other.

In order to accommodate the overlapping finger arrangement, an arcuately shaped seat 106 is formed as a smoothly curved edge on the rearward side of the finger portion 58 to accommodate the abutting lower edge 108 of the finger portion 56. As shown in FIG. 4 and FIG. 7, during insertion and removal of the arms into the passageway, the lower edge 108 of the finger portion 56 will abut against the bottom of the seat 106 which form a stop to the compression movement of the two arms.

By providing seat 106 as an abutment stop, the possibility of over compressing the two legs towards each other is avoided. Although the springy material has sufficient freedom for compression, over extending the compression thereof can snap the arms or permanently deform them. The seat 106 thereby provides a limit for the compression of the arms towards each other in order to avoid permanent drformity or snapping of the arms.

The combined transverse width of the arms, from the apex of cam surface 74 of hand portion 52 to the apex of cam surface 76 of hand portion 54, in the abutting position, as shown in FIG. 4, is substantially equal to the transverse width of the passageway 16 in the female receiving member. In this way, alignment between the arms and the passageway during insertion and removal of the arms through the passageway is provided.

Figure 8:
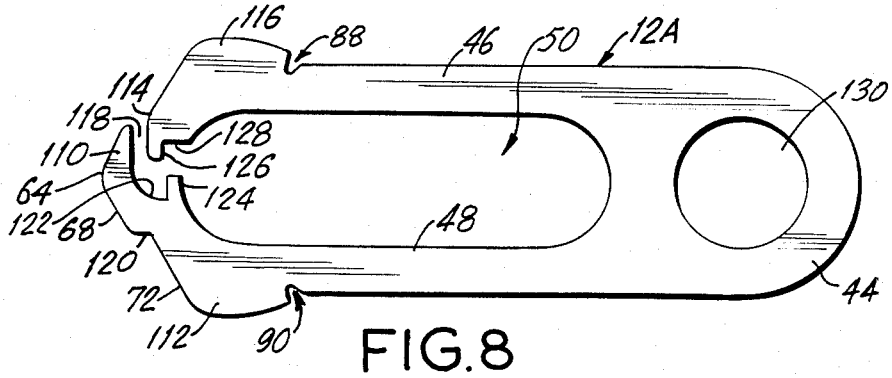
FIG. 8 is a side elevational view, showing another embodiment of an elongated male insert member.

Referring now to FIG. 8, an alternate embodiment of the finger arrangement of the modified male insert member 12A is shown, whereby the remaining portions of the male member are the same as set forth above. Finger portion 110 extends from its respective hand portion 112 and is spaced forward of an in an overlapping relationship with finger portion 114 extending from its respective hand portion 116. The gap 118 spaces the finger portions apart. In order to permit the finger portion 110 to extend forward of finger portion 114, a stepped arrangement 120 is provided between the cam surface 68 on the finger portion 110 and its continued cam surface extension 72 on the hand portion 112.

The arcuately shaped seat 122 formed as a smoothly curved edge on the rearward side of finger portion 110 terminates in an inwardly directed tab 124. The finger portion 114 terminates in a downwardly directed tab 126 at its forward end, which provides a seat 128. The forwardly extending tab 126 is received in the seat 122, while the rearwardly extending tab 124 will abut the bottom of finger portion 114 in the seat 128.

Accordingly, the arrangement shown in FIG. 8, provides an improved abutting arrangement between the two arms in order to prevent over compression therebetween. However, more importantly, at the same time, the two tabs 124, 126 are staggered so as to further prevent the possibility of the edges 30, 32 of the female member 10 passing between the finger portions 110, 114 into the slot 50, thus avoiding an improper insertion, as set forth above.

In order to permit attachment of another end of a chain or bracelet, an aperture 130 is formed in the body portion 44 of the male insert member 12, 12A. Accordingly, the apertures 40 and 130 at the opposing remote ends of the clasp can be used for interconnecting various chains, cords, etc. For example, when used as a jewelry clasp, the apertures can be connected to opposing ends of a chain or bracelet. Similarly, a key chain can be connected in each of the apertures so that each member of the clasp is connected to a separate key. Thus, when one key is being utilized, the clasp can be opened to separate the male and female members so that the other is separated and can be brought to a different location. Although the apertures 130 and 40 are shown as circular, elongated slots or other shaped apertures could be utilized for this purpose.

It should also be appreciated that by utilizing the arrangement of the present invention, the male member herein can be formed with less material then the male member shown in the aforementioned parent application. This is of importance when the device is used as a jewelry clasp, and thus is formed of precious metal such as gold, silver and the like.

Numerous alterations of the structure herein disclosed will suggest themselves to those skilled in the art. However, it is to be understood that the present disclosure related to a preferred embodiment of the invention which is for the purpose of illustration only and is not to be construed as a limitation of the invention.

What is claimed is:

1. A releasable connector comprising:

a female receiving member having opposing longitudinal side walls and opposing longitudinal edges providing an elongated internal passageway extending from one end thereof, and a pair of diametrically opposing retaining slots spacedly positioned along said passageway, said retaining slots being openings extending through said opposing longitudinal edges of said receiving member, said passageway including a mouth at said one end;

a substantially flat elongated male insert member having a pair of elongated forwardly directed spaced apart, springy arms insertable into said passageway upon compression of said arms together into an abutting position;

each of said arms including an outwardly extending enlarged hand portion at a leading end of each arm for releasably locking into a respective one of said retaining slots when said arms spread apart with each hand portion extending through an associated one of said openings to securely retain said insert member in said receiving member in a locked position;

each of said hand portions including cam means for:

(1) engaging said mouth of said passageway to direct said arms together into said abutting position to facilitate entry of said insert member into said passageway, (2) riding along inner edge walls of said passageway to facilitate passage of said insert member through said passageway, and (3) engaging an edge of a respective retaining slot to facilitate entry of said hand portions into said retaining slots and to also facilitate exit of said hand portions from said retaining slots;

an inwardly directed edge on each hand portion rearward of a respective one of said cam means on each hand portion, each inwardly directed edge being disposed at an acute angle rearwardly inclined with respect to longitudinal axis of said insert member to provide a hook-like portion on each hand portion for locking onto said edge of said respective retaining slot;

said hand portions including finger means to prevent walls of said mouth of said passageway from engaging between said hand portions, said finger means including a free end of each hand portion being provided with an inwardly extending finger directed towards the other hand portion, one said finger being spaced forward of and in an overlapping relationship to the other said finger to allow said hand portions to be compressed towards each other and to provide a leading insertion portion for entry into said passageway to thereby facilitate insertion of both arms into said passageway;

abutment means on said hand portions to limit compression of said hand portions together to define said abutting position of said arms, said abutment means including a seat portion provided on a rearward edge of said one finger for abuttingly receiving said other finger thereon; and said hand portions having a combined transverse width in said abutting position substantially equal to a transverse width of said passageway to provide alignment between said arms and said passageway during insertion of said arms through said passageway.

2. A releasable clasp as in claim 1, wherein a nose tip is provided on a forward end of said insertion portion.

3. A releasable clasp as in claim 2, wherein said cam means includes an outwardly flared first cam surface on said insertion portion, said first cam surface rearwardly extending from said nose tip and continuing on to both said hand portions for engaging said mouth of said passageway to direct said arms towards each other and guide entry of said arms into said passageway.

4. A releasable clasp as in claim 3, wherein said cam means includes an arcuate second cam surface on each hand portion, said second cam surface being rearward of said first cam surface for riding along said inner edge walls of said passageway to facilitate passage of said male member through said passageway.

5. A releasable clasp as in claim 4, wherein said cam means includes an inwardly curved, rearwardly directed third cam surface on each hand portion, said third cam surface being rearward of said arcuate second cam surface for engaging said edge of its respective retaining slot to facilitate entry of said hand portions into said retaining slots and to also facilitate exit of said hand portions from said retaining slots.

6. A releasable clasp as in claim 1, wherein an undercut portion extends inwardly from each inwardly directed edge to insure that said inwardly directed edge engages against said edge of its respective retaining slot in said locked position.

7. A releasable clasp as in claim 1, wherein an elongated slot separates said arms.

8. A releasable clasp as in claim 1, wherein said seat has a substantially arcuately shaped configuration, and wherein a lower edge of said other finger is substantially flat.

9. A releasable clasp as in claim 1, wherein an inwardly directed tab is provided on both said seat portion and said other finger, said tabs being directed in opposite directions and staggered with respect to each other.

10. A releasable clasp as in claim 9, wherein said tab on said other finger is forward of the other tab and abuts said seat portion when said arms are compressed, and said other tab abuts said other finger when said arms are compressed.

11. A releasable clasp as in claim 10, wherein said one finger extends forward of its respective hand portion in a stepped arrangement.

12. A releasable clasp as in claim 1, wherein said female receiving member is fabricated from a single sheet of material folded over to provide said passageway.

13. A releasable clasp as in claim 12, wherein said female receiving member includes a flattened section at an opposite end thereof for facilitating connection of articles to said female receiving member.

14. A releasable clasp as in claim 1, and further including apertures provided at opposite remote ends of said clasp in said male member and female receiving member for coupling articles to said clasp.

* * * * *